United States Patent [19]

Attinger et al.

[11] Patent Number: 4,899,495

[45] Date of Patent: Feb. 13, 1990

[54] DISC WHEEL SANDING MACHINE

[75] Inventors: Karl Attinger, Holzmaden; Wolfgang Kuch; Peter Maier, both of Neidlingen, all of Fed. Rep. of Germany

[73] Assignee: Festo K.G., Esslingen, Fed. Rep. of Germany

[21] Appl. No.: 306,506

[22] Filed: Feb. 3, 1989

[30] Foreign Application Priority Data

Feb. 25, 1988 [DE] Fed. Rep. of Germany ..... 3805962

[51] Int. Cl.[4] ..... B24B 23/00

[52] U.S. Cl. ..... 51/170 T

[58] Field of Search ..... 51/170 T, 170 MT, 170 R, 51/272, 273

[56] References Cited

U.S. PATENT DOCUMENTS

| | | | |
|---|---|---|---|
| 3,334,448 | 8/1967 | Alexander | 51/170 T |
| 3,673,744 | 7/1972 | Oimoen | 51/170 T |
| 3,882,644 | 5/1975 | Cusumano | 51/170 T |
| 4,765,099 | 8/1988 | Tanner | 51/170 T |

FOREIGN PATENT DOCUMENTS

| | | | |
|---|---|---|---|
| 3615799 | 11/1987 | Fed. Rep. of Germany | 51/170 T |
| 428280 | 12/1947 | Italy | 51/170 T |

*Primary Examiner*—Judy Hartman

*Attorney, Agent, or Firm*—McGlew & Tuttle

[57] ABSTRACT

A disc wheel sanding machine includes a disc wheel rotated by a drive shaft. The sanding machine has a dust extraction device with a dust extraction hood comprising an extraction chamber which surrounds the disc wheel. The hood of the dust extraction device ends above the disc wheel bottom, and a closing wall in the form of a bristle ring or such like protrudes from the bottom of the hood and can be positioned on the work piece. The bristle ring only encircles a part of the periphery of the disc wheel and forms a suction slot diverging outwardly toward the front end in the direction of rotation of the disc wheel and is open toward the work piece. The sanding dust is sucked through the suction slot at the disc wheel periphery into the extraction chamber. The rear end of the bristle ring with regard to the direction of rotation closes in on the disc wheel periphery and forms a rear seal for the suction slot. Furthermore the hood comprises a sealing section extending over a portion the circumference which does not seal around the disc wheel, leaving a sealing distance allowing for the disc wheel rotation.

16 Claims, 3 Drawing Sheets

DISC WHEEL SANDING MACHINE

BACKGROUND OF THE INVENTION

1. FIELD OF THE INVENTION

This invention relates in general to sanding devices and in particular to a new and useful disk wheel sanding machine having a dust withdrawal device.

The invention relates particularly to a disc wheel sanding machine comprising a disc wheel actuated by a drive shaft into a rotating movement and a dust extraction device with an extraction hood covering the disc wheel and comprising an extraction chamber. Its hood ends above the bottom of the disc wheel. A bristle ring which can be placed onto the work piece protrudes from the bottom of the hood, encompassing only a part of the disc wheel, leaving open a viewing area toward the work piece. Together with the perimeter of the disc wheel, the bristle ring forms an open extraction slot opening toward the work piece and also enlarging toward the front end with regard to the direction of rotation.

Compared to a disc wheel sanding machine with a complete bristle ring, a machine equipped with such a dust extraction hood as described above has an advantage in that the working area can be seen. However, if a part of the complete bristle ring is simply removed, the extraction decreases considerably as secondary air is sucked in.

SUMMARY

According to the invention, a disc wheel sanding machine is provided which insures the extraction of sanding dust generated during the work on the work piece in a manner which is considerably better than the extraction achieved by prior art devices. This object is to be achieved even though the bristle ring or enclosing wall is not complete. This aim is achieved by means of simple and inexpensive construction.

According to the invention, a far end of a dust duct enclosing ring converges in the direction of rotation toward the disc wheel perimeter and forms substantially an opposite or a far end seal of the dust extraction opening. Also the hood has or carries a sealed section or circumferential area free of bristles or the like, the circumferential area being positioned opposite the disc wheel with a sealing distance allowing for disc wheel rotation.

By this arrangement, the interior of the extraction hood is sealed toward the outside in the best possible manner, as the hood interior is provided with communication between the work piece and the outer atmosphere only at the front end of the suction opening, where the distance between the bristle ring or enclosing ring and the disc wheel perimeter is relatively large and at the bottom over the length of the suction opening. Therefore, secondary air cannot enter anywhere, and the extraction force is concentrated on the suction opening of the rotational front end of the dust withdrawal slot with the disc wheel positioned on the work piece. As the machine has to be positioned on the work piece so that the open front end of the suction opening is next to the area to be worked on and a little behind it, when viewed from the direction of rotation, the sanding dust thrown toward the front end of the suction opening is sucked in powerfully and therefore safely. Once the sanding dust is sucked into the interior of the hood, it cannot leave the hood anymore due to the sealing according to the invention.

The course of the sealing ring or bristle ring in respect to the disc wheel perimeter can be achieved without additional expense or effort. Furthermore, the sealed section can be achieved by shaping the hood correspondingly, thus only simple measures are required, which entail hardly any production costs.

Accordingly, it is an object of the invention to provide a disc wheel sanding machine which comprises a housing and a motor. The motor is arranged for rotatably driving a sanding disc which is mounted in the housing for rotation about a substantially vertical axis and which sanding disc has a round horizontal sanding surface which protrudes out of the housing for contact with a work piece. The inventive sanding machine includes a dust extraction hood associated with the housing which includes a first sealing wall portion spaced around the periphery of the disc and a second wall portion which opens radially outwardly of the disc and defines a dust withdrawal slot.

A further object of the invention is to provide a disc wheel sanding machine which includes a dust withdrawal arrangement, which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DETAILED DESCRIPTION OF THE PREFERRED EMBODIMENTS

Figure 3:
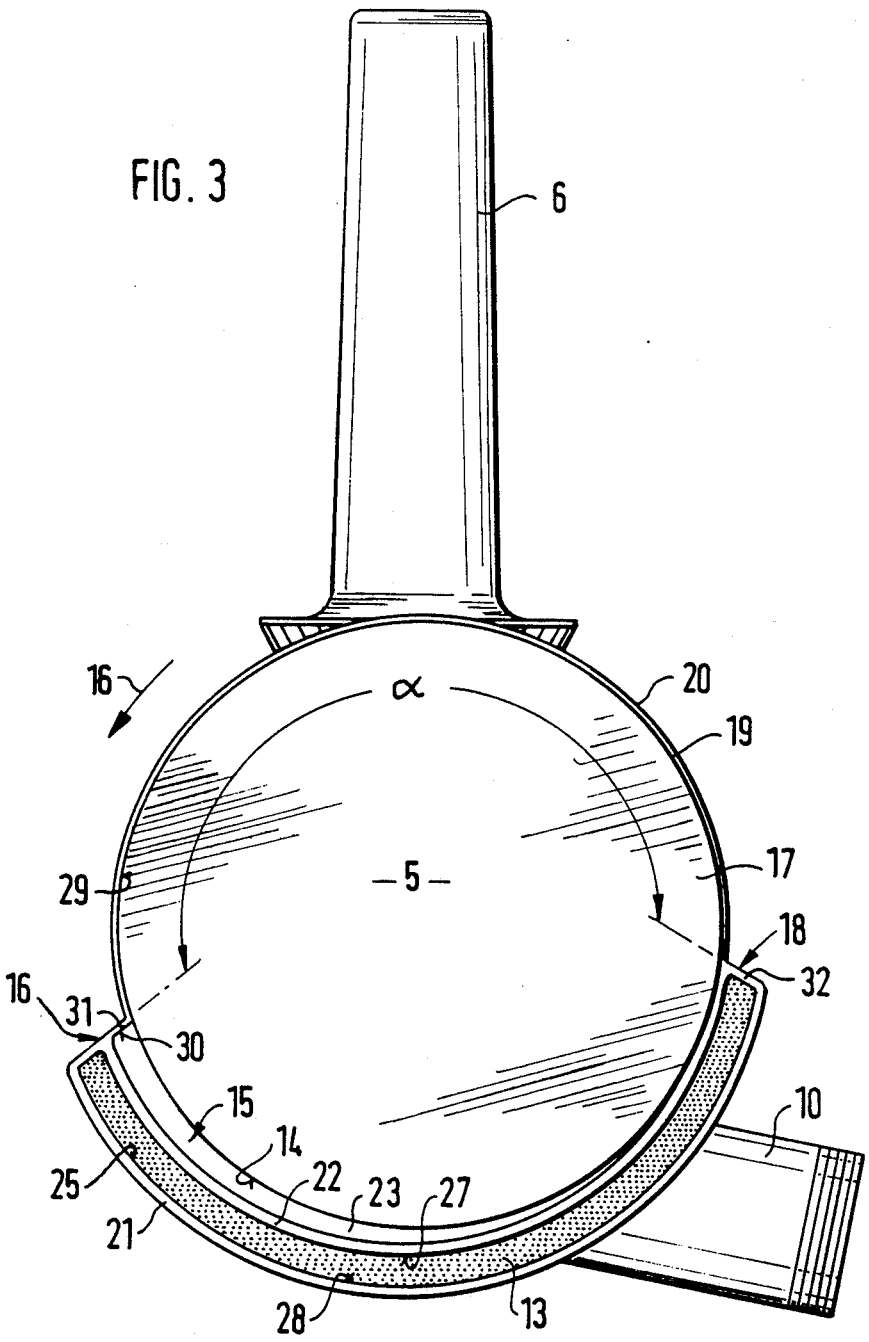
FIG. 3 is a horizontal sectional view of the arrangement in FIG. 1.

Referring to the drawings in particular the invention embodied therein comprises a disc wheel sanding machine having a housing generally designated 1 with a motor driven rotatable sanding device mounted in the housing which includes shaft 4 which is rotatable about a substantially vertical axis so as to rotate a sanding disc wheel so that its bottom surface rotates about a vertical axis in contact with a work piece to be sanded. In accordance with the invention, the housing includes a dust extraction hood device generally designated 7. The dust extraction device includes a hood portion 8 which has a sealing wall portion 19 spaced a small distance from the periphery of the disc 5 to seal around the periphery of the disc 5. The sanding machine also includes a further wall portion as shown in FIG. 3 which diverges outwardly in respect to a direction opposite to the direction of rotation as indicated by the arrow 56. The further wall portion forms a suction slot 15 for the removal of dust material.

The disc wheel sanding machine, which is hand-held, is a socalled angle sander.

The housing 1 comprises a drive motor housing part 2 containing the driving motor and a machine head part 3. A bevel gearing is provided from which the drive shaft 4 runs at a right angle with regard to the longitudinal direction of the housing. The drive shaft 4 drives a circular disc wheel 5 in a rotating movement. The disc wheel 5 is formed of sanding material, or is coated with sanding material. The disc 5 is held against the work piece at an angle, so that only a relatively small segment of the disc makes contact with the work piece.

This angle sander is held with both hands. One hand holds the device at a handle 6 which protrudes laterally from the device housing 1. The housing 1 is arranged above the disc wheel 5. By means of handle 6, the disc wheel 5 can be pushed against the work piece. The other hand can e.g. hold the longitudinal device housing 1, which can be formed ergonomically for this purpose.

To avoid allowing the sanding dust generated during the sanding from going into the environment, a dust extraction device 7 is provided. The dust extraction device 7 includes a hood 8. The extraction hood 8 advantageously encloses the periphery 14 of the disc wheel 5 and covers the upper side of the disc-wheel while keeping some distance from the disc wheel. This arrangement provides an extraction chamber 9 inside the hood and above the disc wheel 5. The extraction device 7 further comprises a dust suction tube 10 joined to the hood 8 and protruding in an approximately tangential direction. The suction tube 10 is connected to the extraction chamber 9. A dust extractor or a dust bag can be connected to the suction tube. A blower (not shown) generates the suction flow. The blower can be arranged externally or inside the device, e.g. in the shape of a blower wheel mounted on the drive shaft 4 and in the extraction path.

The bottom of the hood 8 ends above the disc wheel bottom 11. A bristle ring or enclosing wall 13, e.g. a ring of rubber knobs or a sealing lip made from yielding material, extends downward from the hood 8 and can be positioned adjacent the work piece.

The bristle ring 13 encompasses only a section or the periphery 14 of the disc wheel 5, leaving open a viewing section of the work piece, as can be seen particularly in FIG. 3, wherein the bristle enclosure wall 13 appears dotted. The bristle ring 13 (further wall portion) and the section of the periphery 14 of the disc wheel 5 facing the ring 13 forms a suction slot 15 opening toward the work piece, i.e. downward. The suction slot 15 diverges or opens toward a front end relative to a direction opposite to the direction of rotation shown by arrow 56 of the disc wheel 5. The suction slot 15 is only the slot or opening between the enclosure wall 13 and the periphery of the disc wheel 5. The suction slot has a slot height reaching up to the bottom 12 of the hood.

The device is regularly held so that the disc wheel area 17 in front of the lateral handle 6 works on the work piece. The front end 16 of the suction slot 15, is open in a peripheral direction. Where the distance between the bristle ring 13 and the disc wheel 5 periphery 14 is relatively large. The suction slot 15 is positioned adjacent to the work piece machining area and is usually behind with respect to the direction of rotation 56. The sanding dust is, therefore, cast toward the open front side 16 of the suction slot 15 and is also extracted forcefully, so that it is sucked into the extraction chamber 9 through the suction slot 15 via the disc wheel periphery 14.

The suction slot 15 is sealed by the bristle ring 13 radially toward the outside. The bristle ring or enclosing ring 13 also seals the back of the suction slot !5 by having the rear end 18 in the direction of rotation 16 of the bristle ring closing in on the disc wheel periphery 14. The bristle ring 13 closes in toward the disc wheel periphery 14 in a spiral from the front end 16 to the rear end 18, so that the suction slot 15 is continually diminished in the direction of rotation. While the bristle ring or enclosing ring 13 begins at a front end spaced at a relatively large distance with regard to the disc wheel periphery 14, the bristle ring 13 is preferably as near as possible to the disc wheel periphery at the rear end 18.

That is, the distance of the further wall portion from the disc widens along a peripheral direction of said disc in a direction opposite to the rotation of the disc (from a first end 18 to a second end 16).

The hood 8 also has a sealing section 19 stretching over the free angle section from the bristle ring 13 or the like. The sealing section faces the disc wheel 5 with a sealing distance allowing for the disc wheel rotation. In a preferred embodiment, the sealing section 19 is a one-piece part or wall of the hood 8 as will be explained later. However, it could also be a brush, lip or the like carried by the hood 8. It should be pointed out at this point that the sealing section does not necessarily have to seal against the disc wheel, but that it can also seal off the upper side of the disc wheel.

By the above described arrangement, the extraction chamber 9 is connected to the environment only through the suction slot 15 if the sealing distance allowing for the disc wheel rotation and the possible minor distance between the disc wheel periphery and the rear end of the bristle ring are disregarded. The suction slot 15, which in this example diminishes in a wedge-like fashion, is open at the front and at the bottom. Therefore no secondary air can be sucked in and the suction effect is concentrated on the suction slot 15. Favorably, the sealing section 19 is formed by a ring wall section 20 of the hood 8. The ring wall section 20 runs substantially concentric to the disc wheel periphery !4 and faces the disc wheel periphery at a sealing distance. This ring wall section 20 stretches downward over the disc wheel periphery and ends there a little above the disc wheel bottom 11. A the disc wheel periphery 14 diminishes upward in the shape of a conoid frustrum and the ring wall area 20 ends above the disc wheel bottom 11 close to the disc wheel periphery, the ring wall area 20 protrudes hardly or not at all radially over the disc wheel periphery. The ring wall section 20 may diminish upward in the shape of a conoid frustrum similar to the disc wheel periphery.

The arrangement is chosen preferably so that the hood 8 has a partial ring 21 which protrudes radially over the disc wheel 5 and runs along the disc wheel periphery 14. The partial ring 21 the bristle ring 13 on its bottom. It is favorable if the inside 22 of the partial ring 21 facing the disc wheel 5 runs parallel, i.e. in a spiral, with regard to the bristle ring 13. Also, this outer limitation forms an upward pointing suction slot 23 representing an extension of the suction slot 15. Thus, the suction slot 23 follows the suction slot 15 in the upward direction, having the same longitudinal course in circumferential direction as the suction slot 15. The partial ring 21, such as the ring wall section 20, protrudes upward over the disc wheel periphery. The suction slot 23, which is limited on the outside by the partial ring 21 and on the inside by the disc wheel 5 is closed on the upside by an upper wall 24 of the partial ring 21.

The partial ring 21 has a groove 25 open at its bottom for the reception of a fitting strip 26 with the bristle ring 13. This way the bristle ring 13 or the like can be exchanged easily once it is worn. The fitting strip 26 carrying the bristle ring only has to be pulled out and exchanged for a new one. For the formation of the groove 25, the partial ring has a double wall, the space between the inner wall 27 and the outer wall 28 forming the groove 25.

The ring wall section 20 forming the sealing section 19 and the partial ring 21 carrying the bristle ring 13 form a continuous ring wall around the disc wheel 5. The partial ring 21 is set off radially. The ring wall bottom is completely continuous and forms the hood bottom 12.

At the front end 16 of the bristle ring 13, the inside 29 of the ring wall section 20 forming the sealing section 19 can blend into the inside 22 of the partial ring 21 over a ledge 30 essentially directed radially outward. The ledge 30 is formed by a wall bridge 31 of the partial ring 21 limiting the suction slot 23 at the front end 16.

At the rear end 18 of the bristle ring 13, the inside 22 of the partial ring 21 favorably blends basically continuously into the inside 29 of the ring wall section 20 forming the sealing section 19. Thus, a dead angle is largely or completely avoided. Due to the shape of the suction slot 15 and the suction slot 23 diminishing spiral-like toward the rear end and of the basically continuous transition at the rear end 18 which was just mentioned, the entering dust is continuously turned inward in circumferential direction. This is favorable with regard to the flow.

The rear end 18 also has a wall bridge 32, which only connects the inner wall 27 and the outer wall 28 of the partial ring, as the inner side 22 of the inner wall 27 blends into the inner side 29 of the ring wall section 20.

Figure 1:
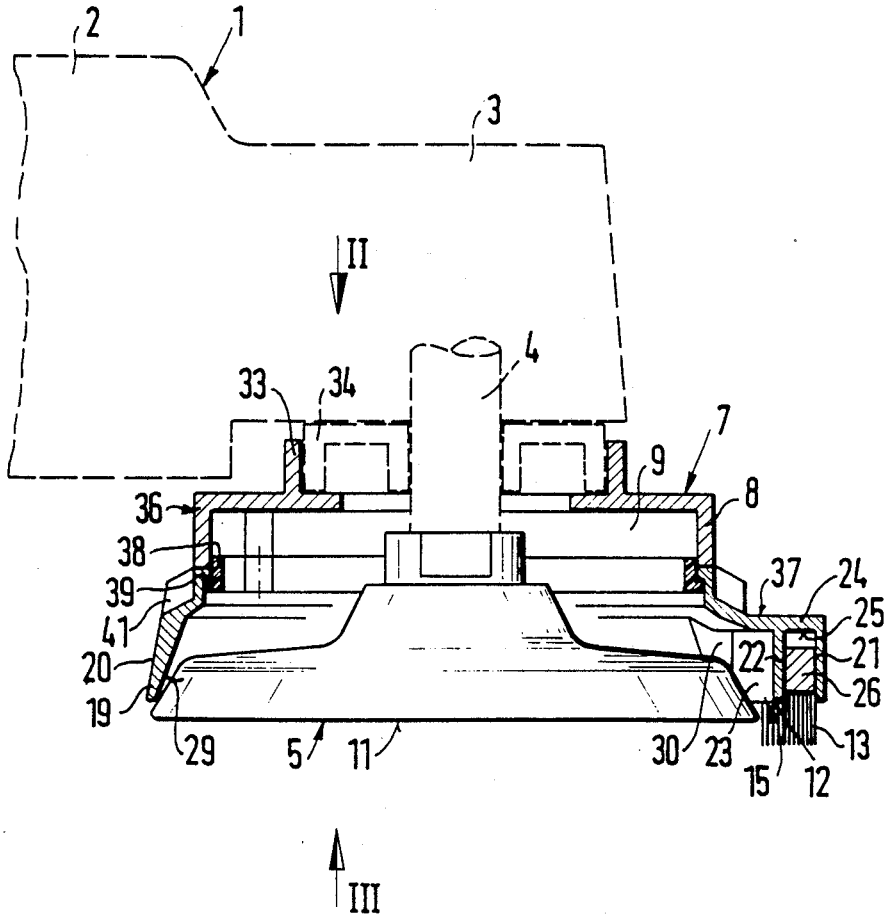
FIG. 1 is a partial transverse vertical sectional view of a disc wheel sanding machine taken along the line I—I of FIG. 2, wherein the disc wheel and the dust extraction hood are shown without handle and dust suction tube.
Figure 2:
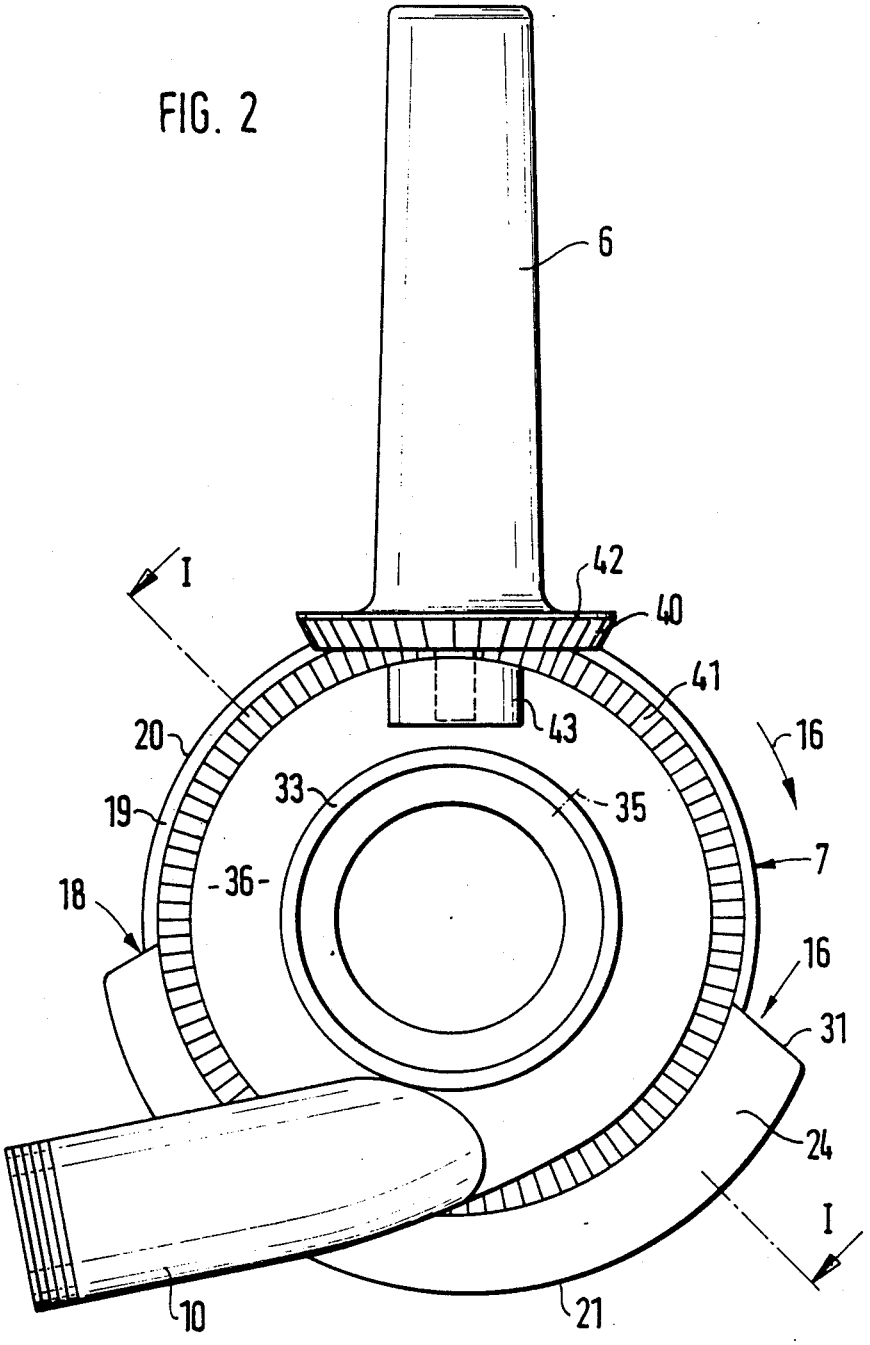
FIG. 2 is a bottom plan view of the device in FIG. 1.

The extraction hood 7 can be fixedly mounted to the device housing 1. However, it is preferably fixed with a detachable connection. For this purpose, the hood 8 may have a cylindrical insertion plug 33, which is plugged onto a coaxial cylindrical housing ledge 34 (shown in a broken line). The detachable connection can be effected by clamping, e.g. by means of a clamping screw 35 shown in FIG. 2 as a broken line.

As a further favorable measure, the hood 8 is subdivided into an upper part 36 which is connected to the device housing preferably by means of the described detachable connection, and into a bottom part 37 comprising the bristle ring 13 and the sealing section 19, the bottom part 37 being mounted rotatable to the upper part 36. Thus, the bottom part 37 can be rotated to an angle favorable for the respective machining process, so that the front end 16 is located at the area to be machined. However, the rotatability of the bristle ring 13 is not necessarily required as this kind of angle sander is usually held at the same angle with regard to the work piece.

The rotatable mounting of the bottom part 37 can be effected by means of a bearing ring 38, which grips behind a ring ledge 39 of the bottom part 37 pointing inward and touching the bottom of the upper part 36 above it and which is screwed to the upper part.

To avoid having to grip the bottom part 37 for the rotation of the bristle ring 13, the handle 6 protruding laterally away from the device housing can be a rotatable handle, which has a driving connection with the bottom part by means of a gear. The handle 6, which has a longitudinal shape and which is mounted at a right angle with regard to the drive shaft on which the disc wheel 5 is mounted, can be rotated around its own axis, and the hood bottom part 37 rotates with it. By this means, the bristle ring 13 can be rotated into the most favorable position for the extraction of dust by the hand holding the handle 6.

Favorably, the gear is a toothed gear. The rotatable handle 6 has a coaxial, toothed wheel 40, which meshes with a toothed rim 41 arranged on the hood bottom part 37. The toothed wheel 40 is arranged on a disc 42 with a larger diameter than the rotatable handle 6. The hood bottom part 37 protrudes radially over the upper part of the hood 36 and carries the toothed rim 41 on the protruding part.

Favorably, the rotatable handle 6 is arranged on the upper part of the hood 36 and can be mounted on a base support 43 protruding upward from the upper part 36.

Finally, it has to be pointed out that the bristle ring 13 and therefore the suction slot 15 and the suction slot 23 favorably extend over an angle area of approximately 180° or less.

While specific embodiments of the invention have been shown and described in detail to illustrate the application of the principles of the invention, it will be understood that the invention may be embodied otherwise without departing from such principles.

What is claimed:

1. A disc wheel sanding machine, comprising a housing, a motor driven rotatable sanding disc mounted to said housing for rotation about a substantially vertical axis, said sanding disc having a round periphery with a horizontal sanding surface exposed out of said housing for contact with a work piece to be sanded, a dust extraction hood connected with said housing and including a sealing wall portion spaced closely around only a portion of the periphery of said disc and a further wall portion spaced closely to the periphery of said disc at a first end of said further wall with the spacing from the further wall portion to the disc widening along a peripheral direction of said disc to a second end of said further wall portion located radially outwardly with respect to the periphery of said disc and defining a dust withdrawal slot with said disc, extending into said dust extraction hood.

2. A disc wheel sanding machine according to claim 1, wherein said further sealing wall portion comprises a bristle ring.

3. A disc wheel sanding machine according to claim 1 wherein said wall portion comprises a ring wall section of said hood arranged substantially parallel to the periphery of said disc.

4. A disc wheel sanding machine according to claim 1, wherein said further wall portion at least comprises a bristle.

5. A disc wheel sanding machine according to claim 4, wherein said further wall portion is spaced outwardly from said disc in a spiral segment from said first end to said second end.

6. A disc wheel sanding machine according to claim 4, wherein said dust extraction hood includes a hood ring portion having a downwardly opening receiving groove, said second wall portion including a solid bristle ring holder carrying a bristle.

7. A disc wheel sanding machine according to claim 3, wherein said sealing wall portion comprises a solid ring sealing around the periphery of said disc and said further wall portion includes a partial ring carried by said extraction hood.

8. A disc wheel sanding machine comprising a housing, a motor driven rotatable sanding disc mounted to said housing for rotation and having a rounded periphery with a disc surface exposed out of said housing for contact with a work piece, a dust extraction hood connected to said housing and including a skirt portion extending around said disc having a sealing wall portion spaced closely around the periphery of said disc and a further wall portion forming a continuation of said sealing wall portion, said further wall portion having a first end spaced closely to said disc periphery, the distance from said further wall portion to said disc widening along a peripheral direction of said disc and said further wall portion having a second end positioned radially outwardly of said disc, said further wall cooperating with said disc periphery to define a dust withdrawal slot with a dust withdrawal slot opening adjacent said further wall second end.

9. A disc wheel sanding machine according to claim 8, wherein said further wall portion is spaced outwardly from said disc in a spiral segment from said first end to said second end.

10. A disc wheel according to claim 8, wherein said hood includes an upper part which is connected to said housing by a detachable connection and a bottom part including said sealing wall portion and said further wall portion, said second wall portion comprising a bristle ring, and means for rotatably mounting said bottom part with respect to said upper part.

11. A disc wheel sanding machine according to claim 10, including a handle extending radially outwardly of said upper part said handle being rotatably mounted to said upper part and having a driving connection to said bottom part.

12. A disc wheel sanding machine according to claim 11, wherein said handle is connected on the upper part of said blood.

13. A disc wheel sanding machine according to claim 11, wherein said driving connection comprises interengaged bevelled gears.

14. A disc wheel sanding machine according to claim, 13, wherein said handle includes a toothed bevel wheel, said lower part having a gear rim engaged with said toothed wheel.

15. A disc wheel sanding machine according to claim 8, wherein said further wall portion comprises a bristle ring, said sealing wall extending approximately over a range of an angle of 180°.

16. A disc wheel sanding machine according to claim 1, wherein the widening of the spacing from the further wall portion to the disc occurs along a peripheral direction of said disc opposite to the direction of rotation of said disc.

* * * * *